United States Patent [19]

Musgrave

[11] 4,219,953

[45] Sep. 2, 1980

[54] MAGAZINE STATUS INDICATING DEVICES

[76] Inventor: Daniel D. Musgrave, 8201 Caraway St., Cabin John, Md. 20731

[21] Appl. No.: 17,039

[22] Filed: Mar. 2, 1979

Related U.S. Application Data

[63] Continuation-in-part of Ser. No. 952,698, Oct. 19, 1978, which is a continuation-in-part of Ser. No. 907,165, May 18, 1978, Pat. No. 4,142,313.

[51] Int. Cl.[3] ..... F41C 27/14

[52] U.S. Cl. ..... 42/1 B; 42/50

[58] Field of Search ..... 42/1 B, 50

[56] References Cited

U.S. PATENT DOCUMENTS 4,142,313 3/1979 Musgrave ..... 42/1 B

*Primary Examiner*—Charles T. Jordan

[57] ABSTRACT

Sonic devices to indicate that no cartridges are present in a magazine, or that at least one cartridge is present.

7 Claims, 10 Drawing Figures

MAGAZINE STATUS INDICATING DEVICES

This application is a continuation-in-part of co-pending application Ser. No. 952,698 filed Oct. 19, 1978 and entitled Magazine Status Indicating Process, which in turn is a continuation-in-part of application Ser. No. 907,165 filed May 18, 1978 and entitled Magazine Status Indicators, which is now U.S. Pat. No. 4,142,313.

Many firearms use detachable magazines which can be removed from the firearm when empty and replaced by full magazines. Some of these magazines have a large capacity so that during firing it is difficult for the user to remember how many cartridges remain in the magazine. Some firearms include devices which indicate to the user when the last shot has been expended, otherwise he might be holding an empty firearm and not be aware of the situation. Obviously, it would be an advantage if the user could be informed when he still has one shot available; thus he could exchange magazines while the firearm still has the capability to fire a shot.

Of course, it should be understood that in most firearms having magazines, when only one shot remains it is in the barrel, and the magazine is empty. But some firearms ram the cartridge from the magazine only when it is to be fired.

With either arrangement, if the user can be made aware that he has only one cartridge remaining in the firearm, he can either fire it, or retain it ready to fire while he exchange magazines.

The principal object of this invention is to provide devices by which the user can determine whether or not a cartridge is present in a magazine.

This and other objects of the present invention will be apparent upon reference to the following specification, taken in connection with the accompanying drawings, wherein.

The drawings are not to scale and are simplified for clarity of disclosure. No particular magazine is shown, as the invention can be applied to various magazines, including some which may differ in detail from those illustrated.

Figure 1:
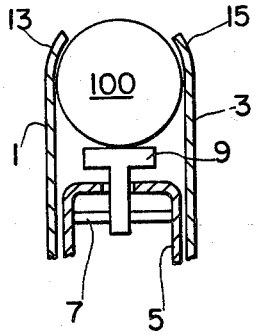
FIG. 1 is a cross-section of the upper portion of a magazine showing a pivotable platform mounted on a follower therein.

FIG. 1 shows a portion of a magazine having side walls 1 and 3 and a moveable cartridge follower 5. Pivotably mounted on follower 5 by means of pin 7 is platform 9. The pin is affixed to the sides of the folower in any suitable manner.

Figure 2:
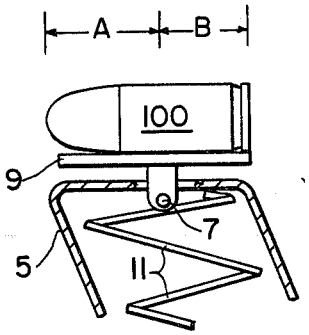
FIG. 2 is a longitudinal section of the follower shown in FIG. 1.

FIG. 2 shows the follower out of the magazine and also shows how a typical wire coil spring 11 can engage the follower to urge cartridges in the magazine toward the feed position in the usual manner.

In FIG. 1 a cartridge 100 is resting on platform 9. Assuming that a spring such as 11 is thrusting the follower and the platform upward, cartridge 100 will be pushed against feed lips 13 and 15 in the usual manner. When this condition occurs, platform 9 will be held firmly between the cartridge and the follower as may be seen also in FIG. 2. If the magazine should than be shaken, the follower will not rattle.

Figure 3:
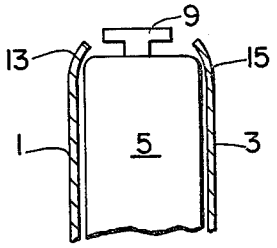
FIG. 3 is similar to FIG. 1 but a part has been moved.

The dimensions of the platform are so chosen that it can pass between lip 13 and lip 15 as may be seen in FIG. 3. When no cartridge is in the magazine the platfrom can oscillate on the follower and impact it. This serves as a sonic indication that the magazine is empty. It may be desirable in some instances to so choose the axis of oscillation of the platform that the platform will be definitely unbalanced on the pin. This is indicated by arrows A and B in FIG. 2 which show that portions of the platform on each side of the axis differ in length.

The unbalanced arrangement will assure that the platform will oscillate even if the magazine is shaken up and down, that is, along the vertical axis of FIGS. 1, 2, and 3.

Figure 4:
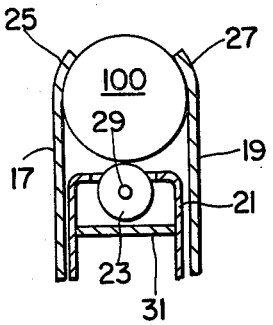
FIG. 4 is a cross-section of the upper portion of a magazine showing a roller mounted on a follower therein.

FIG. 4 shows a portion of a magazine having side walls 17 and 19 and a moveable cartridge follower 21. The top of the follower is slotted to provide a recess for mounting a roller 23, which can transmit the thrust of the follower to a cartridge 100 which is positioned between lip 25 and lip 27 at the top of the magazine. The use of such feed lips is well-known in the art and need not be further described here.

Figure 5:
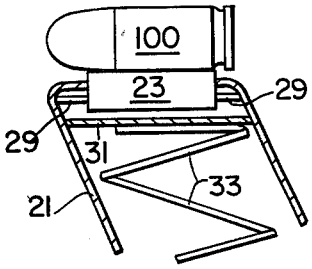
FIG. 5 is a longitudinal section of the follower shown in the magazine in FIG. 4.

Roller 23 is loosely mounted on a shaft 29 which is fixed in follower 21 as may be seen in FIG. 5. Also fixed in the follower is a thrust plate 31 which is adapted to receivd the upward thrust of a typical wire coil spring 33.

Figure 6:
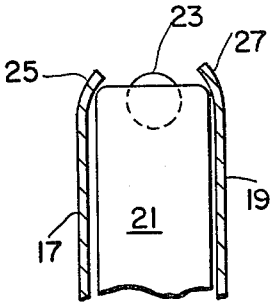
FIG. 6 is similar to FIG. 4 but a part is shown in a different position.

The effect of this arrangement is that when a cartridge is present, as in FIG. 4, spring thrust on the follower is transmitted via the roller to the cartridge. There is then no tendency for the roller to rattle when the magazine is shaken. When no cartridge is present, as in FIG. 6, the follower will contact the lips but the roller is free to rattle and thus signal that the magazine is empty. To increase the sonic effect, the roller can be made hollow.

Figure 7:
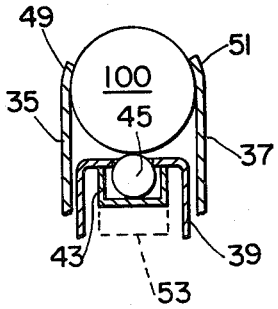
FIG. 7 is a cross-section of the upper part of a magazine showing a ball positioned in a follower therein.

FIG. 7 shows a portion of a magazine having side walls 35 and 37 and a moveable cartridge follower 39. A recess 41 is formed in the top of the follower, it being best seen in FIG. 10. Below the recess a box 43 is affixed to the follower, it serving as a retainer for a ball 45 which protrudes slightly above the upper surface of the follower as may be noted in FIGS. 7, 8, and 9. The dimensions of the ball, the box, and the recess are so chosen that the ball can move somewhat in the box, but that such movement can be prevented by contact with a cartridge 100 which rests on the follower in FIG. 7 and FIG. 8.

Figure 8:
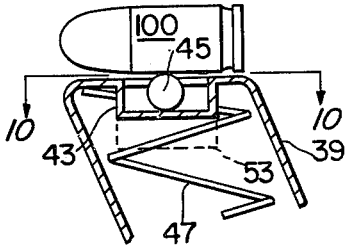
FIG. 8 is a longitudinal section of the follower in the magazine shown in FIG. 7.

A typical wire coil spring 47 can be positioned to exert upward thrust on follower 39 in FIG. 8. When the follower is thrust upward, ball 45 is held between the follower and any cartridge which happens to be in the magazine. Such a cartridge would be pushed against lip 49 and lip 51 as may be seen in FIG. 7. When the ball is thus held, it will not rattle.

Figure 9:
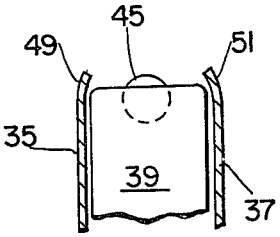
FIG. 9 is similar to FIG. 7 but a part is shown in a different position.

When no cartridge is present, as in FIG. 9, the follower contacts lips 49 and 51 but the ball is free to rattle as its diameter is less than the distance between the lips. The sound made by the ball as it rattles indicates that the magazine is empty. To accentuate the sound the ball can be hollow, or a resonance box can be positioned below retainer box 43. Such a resonance box is indicated by broken lines in FIG. 7 and FIG. 8 and is numbered 53.

Figure 10:
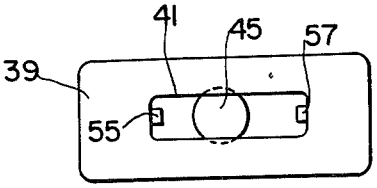
FIG. 10 is a view of a portion of the follower shown in FIG. 9, from the direction indicated by line 10—10 on FIG. 8.

Retainer box 43 can be made elongated in one dimension as is best seen in FIG. 8. To increase the sonic effect as the ball strikes either end of the box, lugs such as 55 and 57 can be fixed within the box at each end, as can be seen in FIG. 10. Furthermore, a plurality of balls can be provided, if desired, to make a distinctive sound.

There is thus disclosed several magazine status indicating devices which can be used to inform a user whether or not any cartridges are in a magazine. With any of these devices the user simply shakes the magazine and listens for a sonic signal. This may be done while the magazine is installed in a weapon, or while it is removed from the weapon. The disclosed devices may be employed with magazines for various classes of weapons. To increase the sound effect, the ball shown in FIGS. 7, 8, 9, and 10 could be made of a hard and dense material such as an alloy of tungsten.

What I claim is:

1. A magazine status indicating device comprising: a cartridge follower adapted for use in a magazine having a pair of lips with an exit port therebetween, said magazine including means to bias said follower toward said lips; and a cylinder loosely supported on said follower, said cylinder being positionally adapted to pass between said lips; whereby a cartridge positioned between said lips can prevent movement of said cylinder relative to said mounting means and whereby when no cartridge is positioned between said lips said cylinder is free to rattle relative to said follower.

2. An indicating device as set forth in claim 1 wherein said cylinder is hollow.

3. A magazine status indicating device comprising: a cartridge follower adapted for use in a magazine having a pair of lips with an exit port therebetween, said magazine including means to bias said follower toward said lips; and a ball loosely retained in a recess in said follower, said ball protruding slightly from a surface of said follower which surface is adapted to engage a cartridge positioned in said magazine; whereby a cartridge positioned between said lips can prevent movement of said ball relative to said recess; and whereby when no cartridge is positioned between said lips said ball is free to rattle in said recess.

4. An indicating device as set forth in claim 3 wherein one dimension of said recess is substantially greater than other dimensions of said recess.

5. An indicating device as set forth in claim 3 wherein said ball is hollow.

6. An indicating device as set forth in claim 3 wherein said follower includes resonant means positionally adapted to accentuate sound caused by said ball rattling in said recess.

7. An indicating device as set forth in claim 3 wherein said ball is composed of an alloy which includes tungsten.

* * * * *